US007808390B2

(12) United States Patent
Sayegh

(10) Patent No.: US 7,808,390 B2
(45) Date of Patent: Oct. 5, 2010

(54) SECURITY TAG HAVING A SWIVELING ENGAGEMENT

(76) Inventor: Adel Sayegh, 5143 Paddock Pl., Rancho Cucamonga, CA (US) 97137

( * ) Notice: Subject to any disclaimer, the term of this patent is extended or adjusted under 35 U.S.C. 154(b) by 513 days.

(21) Appl. No.: 11/620,632

(22) Filed: Jan. 5, 2007

(65) Prior Publication Data

US 2008/0165014 A1 Jul. 10, 2008

(51) Int. Cl.
*G08B 13/14* (2006.01)

(52) U.S. Cl. ..... 340/572.8

(58) Field of Classification Search ... 340/572.1–572.9, 340/568.1

See application file for complete search history.

(56) References Cited

U.S. PATENT DOCUMENTS 3,858,280 A 1/1975 Martens
3,911,534 A 10/1975 Martens et al.
3,932,918 A 1/1976 Paskert
3,942,829 A 3/1976 Humble et al.
3,974,581 A 8/1976 Martens et al.
4,221,025 A 9/1980 Martens et al.
5,788,294 A * 8/1998 Leon et al. ..... 292/307 R
6,052,876 A 4/2000 Hogen et al.
6,535,130 B2 3/2003 Nguyen et al.
D492,215 S 6/2004 Lu
6,933,847 B2 * 8/2005 Feibelman ..... 340/572.1
7,062,823 B2 * 6/2006 Copen et al. ..... 24/704.1
7,183,914 B2 * 2/2007 Norman et al. ..... 340/568.1
7,243,963 B2 * 7/2007 De Lima Castro ..... 292/315
2002/0154014 A1 * 10/2002 Elston ..... 340/572.8

FOREIGN PATENT DOCUMENTS

CN 2572495 Y 9/2003

* cited by examiner

*Primary Examiner*—Phung Nguyen
(74) *Attorney, Agent, or Firm*—Milord A. Keshishian

(57) ABSTRACT

A security tag having a lanyard member that engages an article and the lanyard is secured to the tag body in a moveable manner such that the application of a turning force to the lanyard does not cause the lanyard to twist.

17 Claims, 2 Drawing Sheets

SECURITY TAG HAVING A SWIVELING ENGAGEMENT

CROSS-REFERENCE TO RELATED APPLICATIONS

This application claims priority from non-provisional U.S. design patent application Ser. No. 29/249,235, filed on Sep. 27, 2006, the contents of which are incorporated herein by reference.

FIELD OF THE INVENTION

The invention relates to theft deterrent and security tags in general, and in particular to a disposable tag body containing a swiveling engagement having a marker comprised of either an electronic article surveillance (EAS) or for RFID device, or a combination of both.

BACKGROUND OF THE INVENTION

Various types of theft deterrent and article monitoring devices are known in the art. Electronic article surveillance (EAS) systems are known having the common feature of employing a marker or tag which is affixed to an article to be protected against theft, such as merchandise in a retail store. When a legitimate purchase of the article is made, the marker can either be removed from the article, or converted from an activated state to a deactivated state. Such systems employ a detection arrangement, commonly placed at all exits of a retail store, and if an activated marker passes through the detection system, it is discovered by the detection system and an alarm is triggered. In addition, other tags are known that utilize ink vials that break and release a permanent staining fluid onto the article if the tag is not removed by an authorized individual.

U.S. Pat. Nos. 3,911,534 and 3,974,581 to Henry J. Martens et al. disclose a security tag having the pin contained on a first strip that is attached by a hinge to a second strip that has the locking component thereon. The hinged attachment may lead to the bending of the pin when contacting the locking component because of the predetermined arc that it must travel as a result of the hinged arrangement. Furthermore, the hinged arrangement allows the pin to protrude vertically when the device has fallen to the floor and may lead to injury. The '534 and '581 patents also disclose a pin soldered to a chain at one end and the other end of the chain riveted to the tag cover. The riveting of the chain on the outside of the tag body may subject the tag to easy defeat by unscrupulous individuals.

U.S. Pat. No. 3,932,918 to Paskert discloses a releasably attachable clip for attachment to certain cloth articles, wherein the pin component is incorporated into the tag. However, the pin once again is held in a substantially hinged relation to the locking component and may lead to bending of the pin as a result of the arc which must be traveled in order to engage the locking component. Furthermore, the '918 patent may only be used with articles made of cloth and cannot engage solid components as disclosed in the instant invention.

U.S. Pat. No. 3,942,829 to Humble et al. discloses a security tag having the pin contained on a first strip that is attached by a hinge to a second strip that has the locking component thereon. The hinged attachment may lead to the bending of the pin when contacting the locking component because of the predetermined arc that it must travel as a result of the hinged arrangement. In addition, the hinged arrangement allows the pin to protrude vertically when the device has fallen to the floor and may lead to injury. Furthermore, the '829 patent may only be used with articles made of cloth and cannot engage solid components as disclosed in the instant invention.

U.S. Pat. No. 6,535,130 to Nguyen et al. discloses a complex electronic tag having visual and audible alarm systems incorporated into the tag body itself. The tag also incorporates a lanyard that is made of an electrical circuit wire that will cause an audible or visual alarm in the tag body to be activated should the lanyard be cut. The Nguyen device, however, uses a traditional independent pin having a head to attach the lanyard to an article, thereby possibly leading to work place injuries when the pin is dropped on the floor.

U.S. Pat. No. 6,933,847 to Feibelman discloses an anti-theft tag that utilizes a lanyard where an additional crimping tool and open access to the interior of the tag is necessary in order to attach one end of the tag to the lanyard. The crimping tool of Feibelman may be easily lost and is difficult to negotiate by a user when attempting to hold the article to be tagged and the tag itself during such complex attachment manipulation. In addition, the Feibelman device may be defeated by an unscrupulous individual that inserts a screwdriver or similar tool within the loop created by the lanyard and continues turning the tool until the lanyard twists around itself and leads to failure of the lanyard or the plastic housing.

The prior art does not address the need for an integrated security tag that is difficult to defeat and easy to use. In addition, the prior art fails to provide a theft deterrent tag assembly that allows attachment of the lanyard to the tag without the need for a separate tool. Therefore, there remains a long standing and continuing need for an advance in the art of security devices and theft deterrent tags that makes the tags more difficult to defeat, simpler in both design and use, more economical and efficient in their construction and use, and provides a more secure engagement of the article.

SUMMARY OF THE INVENTION

Accordingly, it is a general object of the present invention to overcome the disadvantages of the prior art.

Therefore, it is a primary objective of the invention to provide a security tag that is more difficult to defeat.

It is another objective of the invention to provide a security tag that is cost-efficient in use and manufacture.

It is a further objective of the invention to provide a security tag that may be disposable.

In keeping with the principles of the present invention, a unique security tag is disclosed wherein a lanyard passes through an article to be monitored and is securely maintained within the tag body by an attaching member that receives the lanyard. The attaching member being maintained within the tag body in a secure yet moveable manner such that a turning force applied to the lanyard does not cause the lanyard to twist. The attaching member also has an attaching mechanism that does not require a tool to be inserted into the tag body to secure the lanyard within the attaching member in a secure manner.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention. In the drawings, wherein similar reference characters denote similar elements throughout the several views.

DETAILED DESCRIPTION OF THE INVENTION

Figure 1:
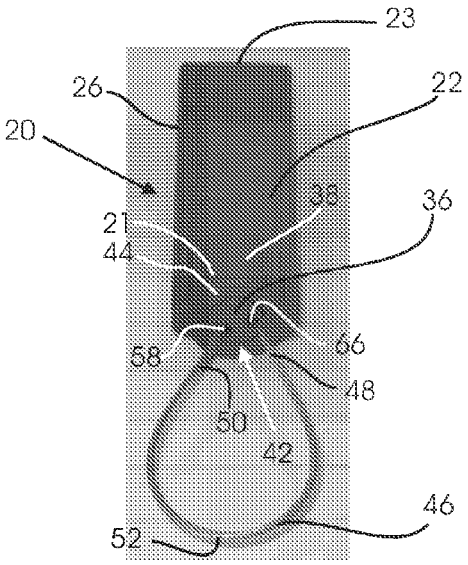
FIG. 1 is a front end perspective view of the tag of the instant invention in an assembled state.
Figure 2:
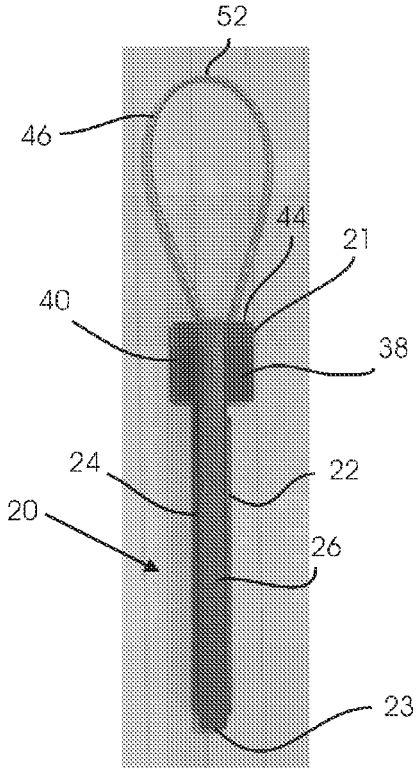
FIG. 2 is a side elevational view of the tag of the instant invention in an assembled state.
Figure 3:
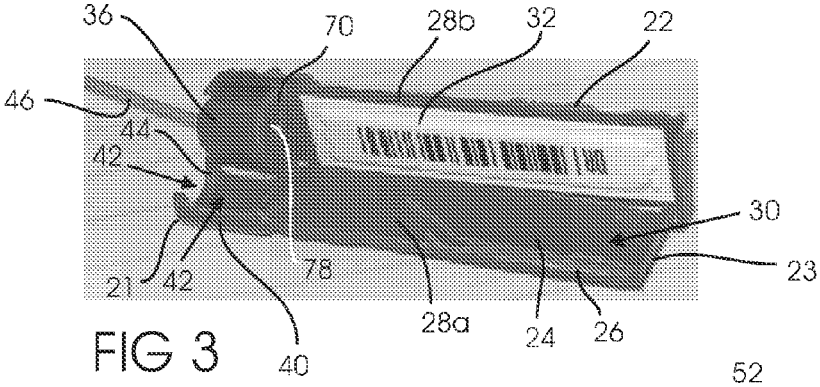
FIG. 3 is a perspective exploded view of the tag of the instant invention showing the inside of the tag body and the attaching member.
Figure 4:
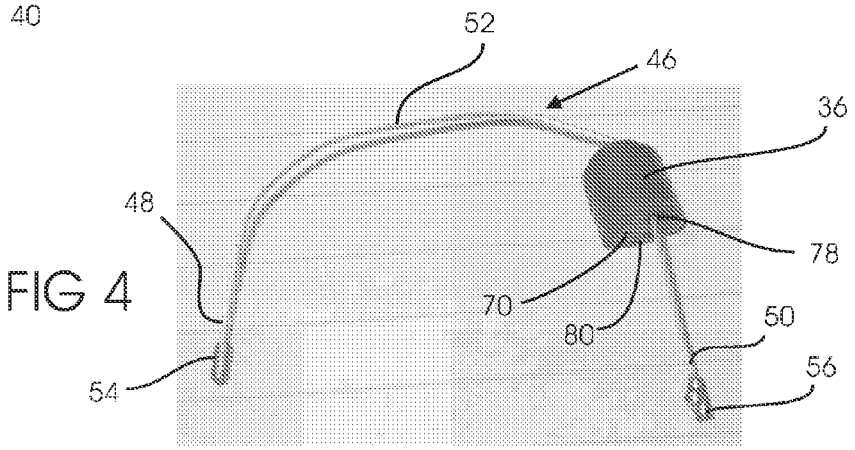
FIG. 4 is a perspective view of the attaching member removed from the tag body.
Figure 5:
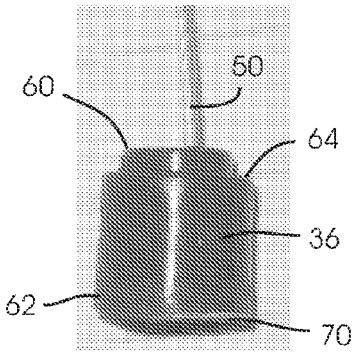
FIG. 5 is a side elevational view of the attaching member removed from the tag body.
Figure 6:
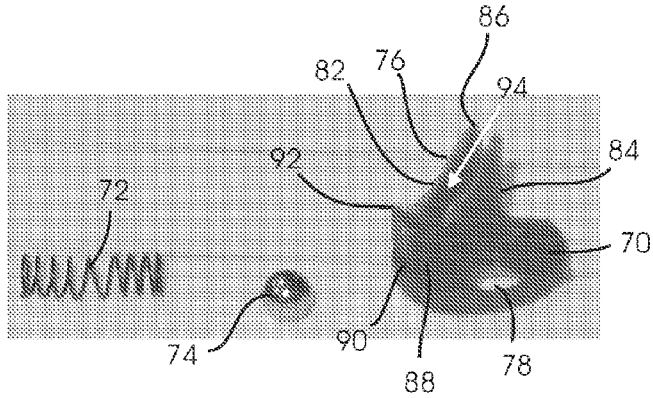
FIG. 6 is an exploded view of the cap, biasing member, and ball of the attaching member of the instant invention.

Referring now to FIGS. 1, 2 and 3, a tag body 20 is illustrated having a first half 22 and a second half 24. First and second halves 22 and 24 are preferably made of a hard or rigid material and are adapted to attach to one another and form a front end 21 and a rear end 23. A usable rigid or hard material might be a hard plastic such as, for purposes of illustration but not limitation, an injection molded ABS plastic or like material.

Second half 24 has a peripheral wall 26 extending inwardly from an inner surface 28*a* of second half 24 and securely engaging—along a substantial portion of the periphery thereof—first half 22. Peripheral outer wall 26 of tag 20 encloses the tag body except for the front end 21. If plastic or like material is used for the body of tag 20, the mating of peripheral wall 26 to first half 22 can be accomplished via an ultrasonic weld or like joining mechanism. However, it is to be understood that other joining methods, such as adhesives for example, may also be used. Inner surface 28*b* of first half 22 and inner surface 28*a* of second half 24 create a cavity 30 within which a marker 32 is enclosed.

Marker 32 may be an Electronic Article Surveillance ("EAS") device or any electronic means of monitoring an article to which it is attached. Conventional EAS devices or tags include a resonator that, when activated, causes an alarm to sound when the EAS tag is brought within operative proximity of detection apparatus (which is typically located at the exit of a store). Marker 32 may also be a radio-frequency ("RFID") device. RFID is a generic term for technologies that use radio waves to automatically identify objects such as tagged products. There are several conventional methods of identifying objects using RFID, the most common of which is to store a serial number (and other information if desired) that identifies the object on a microchip that is attached to an antenna. The chip and the antenna, together with any supporting substrate, herein are called an RFID device or an RFID tag. The antenna enables the chip to transmit the identification information to a reader. The reader converts the radio waves from the RFID device into a form that can then be utilized by a computer and read by a user. Marker 32 may also be any transponder or a combination of both an EAS and RFID device, and can also incorporate any later developed technology to track inventory or surveil articles. Marker 32 is adapted to operate along the lines of a frequency modulated (FM) radio and also amplitude modulated (AM) radio signals.

A chamber 34—defined between first half 22 and second half 24—securely maintains an attaching member 36 therein in a swiveling or rotating manner. Chamber 34 is created by a first protrusion 38 extending outwardly from first half 22 and a second protrusion 40 extending outwardly from second half 24. In one preferred embodiment, chamber 34 is located proximal to front end 21 of tag body 20. First protrusion 38 and second protrusion 40 have an inwardly extending lip 44 such that lip 44 defines an opening 42. Inner surface of first protrusion 38 and second protrusion 40 are substantially concave and form a substantially cylindrical chamber 34 when the tag body is attached. Although a cylindrical embodiment is herein presented, it is to be understood that attaching member 36 and chamber 34 may be substantially spherical, or any other appropriate shape that would allow the swiveling of attaching member 36 within chamber 34. In fact, attaching member 36 may take any shape that does not prevent it from being moveably maintained within chamber 34. And, as a further example, attaching member 36 may be substantially conical.

Now also referring to FIGS. 5 through 9, an engaging element 46 has a first end 48 and a second end 50, at points distal to one another, and a middle region 52 therebetween. Engaging element 46 may be a lanyard preferably formed of stainless steel cable or like material that is flexible yet strong. A first catch 54 is attached to first end 48 and a second catch 56 is attached to second end 56 and are preferably cylindrical in shape. First catch 54 and second catch 56 may be formed by crimping a metal element onto first end 48 and second end 50, respectively, or by soldering thereon. In addition, first and second catches 54 and 56 may also preferably be formed by crimp splices. In one preferred embodiment, first catch 54 has a smaller diameter than second catch 56 such that first catch 54 can pass through a first aperture 58 defined through attaching member 36, as defined below in greater detail.

Attaching member 36 is substantially cylindrically shaped having a leading end 60 and a trailing end 62. In one preferred embodiment, leading end 60 has a smaller diameter than trailing end 62 such that a peripherally extending ridge 64 is formed at the transition between leading end 60 and trailing end 62. Ridge 64 is engaged by lip 44 of tag body 20 in a swiveling yet secure manner such that leading end 60 is substantially flush with front end 21 when assembled. First aperture 58 is defined by the attaching member and traverses from leading end 60 to trailing end 62. First catch 54 is fed through aperture 58 from trailing end 62 such that first catch 54 emanates from leading end 60. However, as a result of the larger diameter of second catch 56, it cannot pass through the aperture 58 and is securely maintained within attaching member 36.

A second aperture 66 is also defined by and extends from leading end 60 to trailing end 62 of attaching member 36. First end 48 of engaging element 46 is passed through an article to be monitored and first catch 54 is inserted into second aperture 66 and is securely therein via an attaching mechanism 68. In such a state, the article to be monitored is maintained within a loop formed by engaging element 46. Furthermore, in said state, an unscrupulous individual will not be able to insert a screw driver or similar tool within the loop and turn the same into a tightening helical form in an attempt to break the engaging element 46 or cause failure of the tag body 20. Attempts to turn the screw driver in order to twist the engaging element 46 upon itself will not be successful because it will result in the swiveling of the attaching member 36 within tag body 20.

Attaching mechanism 68 is comprised of a cap 70, a biasing member 72, and a ball 74. Ball 74 is larger in diameter than second aperture 66 and cannot travel therethrough. Cap 70 is substantially disc shaped and is adapted to be received on trailing end 62 of attaching member 36. Cap 70 has an elevated region 76—that is substantially shaped like a right triangle—extending inwardly therefrom. Cap 70 also has a first hole 78 and a second hole 80 defined through the disc region thereof. First hole 78 and second hole 80 have the same size as and are axially aligned with first aperture 58 and second aperture 66, respectively. Elevated region 76 has a first side 82 that is inclined and is similar to a hypotenuse of a right triangle, a second side 84 extends downwardly from a top portion 86 of first side 82 in a substantially perpendicular manner to disc region of cap 70. A third side 88 is defined on said flat region of the cap 70 and forms the final side of the triangular elevated region 76 and attaches to a bottom portion 90 of first side 82. Bottom portion 90 is distal to top portion 86 of first side 82.

A base 92 emanates vertically from disc region of cap 70 at bottom portion 90 of first side 82. Base 92 is adapted to receive one end of biasing member 72 thereon such that biasing member 72 is maintained in parallel alignment with and rests on top of first side 82. The other end of biasing member 72 rests proximal to top portion 86 of first side 82.

In one preferred embodiment, first side 82 and second side 84 have an axially extending concavity along the lengths thereof such that a first channel 94 is defined along first side 82 and a second channel 96 is defined along second side 84. Biasing member 72 and ball 74 are adapted to travel on top of the side rail like structures created by first channel 94 without falling into second channel 96.

Figure 7:
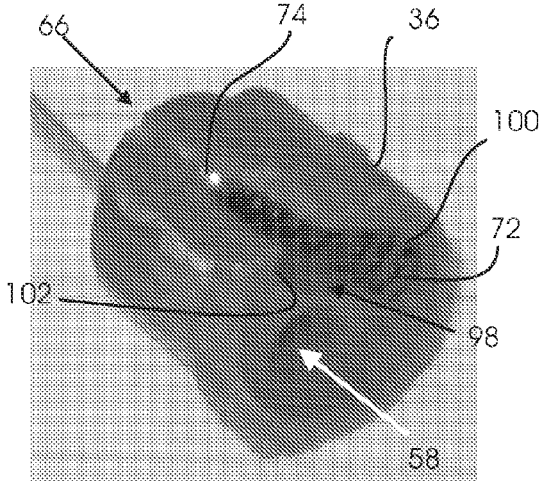
FIG. 7 is perspective partial cutaway view of the attaching member without the cap showing the biasing member and ball maintained therein.
Figure 8:
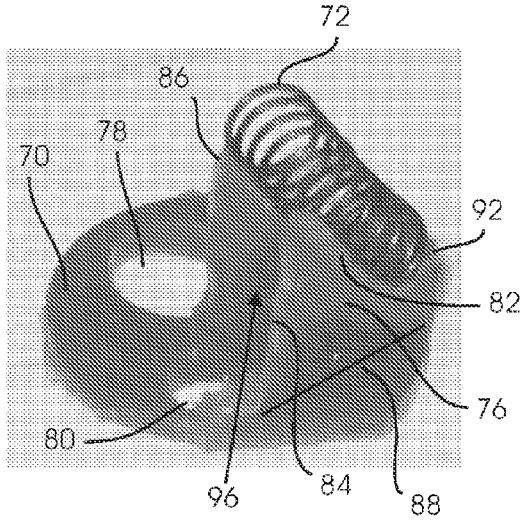
FIG. 8 is a side perspective view of the cap with the biasing member resting thereon.
Figure 9:
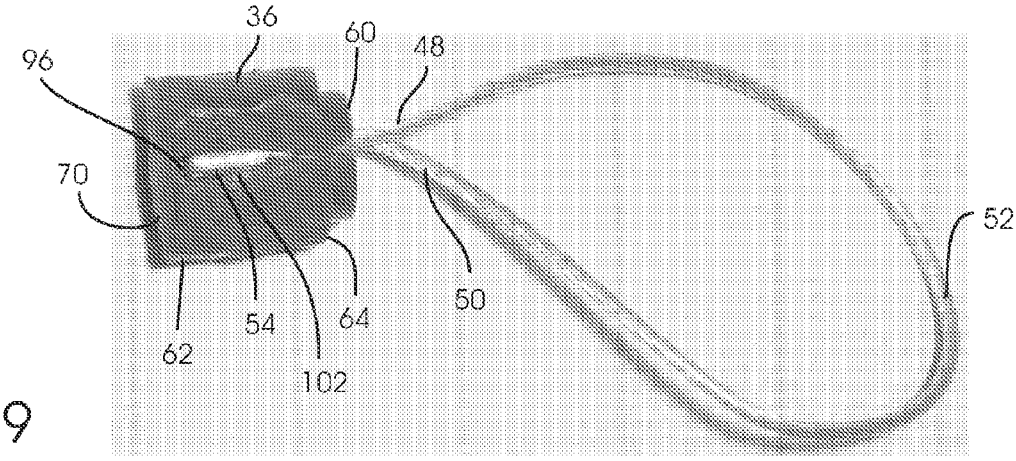
FIG. 9 is a partial cutaway side elevational view of the attaching member with the engaging element maintained therein.

Now referring more particularly to FIG. 7, a crevice 98 is formed within attaching member 36 from trailing end 62 thereof, the apex of crevice 98 communicating with second aperture 66. A first wall 100 and a second wall 102 oppose one another, with first wall 100 being angled such that it is in parallel alignment with first side 82 and first wall 100 culminating at second aperture 66. Second wall 102 being vertically aligned such that it is in substantial parallel alignment with second side 84, and second wall 102 culminating at second aperture 66 at one end and at second hole 80 at another end.

When attaching mechanism 68 is inserted into crevice 98 of attaching member 36, ball 74 is maintained at top portion 86 of first side 82 by the application of force from biasing member 72 thereto. Ball 74 and biasing member 72 are moveably maintained between first side 82 and first wall 100 and maintained within first channel 94. Now referring more particularly to FIG. 9, when first catch 54 is inserted into second aperture 66, it pushes ball 74 toward biasing member 72, whereby biasing member 72 is compressed and ball 66 moves away from top portion 86 and toward base 92. First catch 54 travels into second channel 96 defined between second wall 102 and second side 84. When first catch 54 is inserted up to a predetermined length such that first end 48 is proximal to ball 74, biasing member 72 expands and forces ball 74 toward top portion 86 and second aperture 66 thereby occluding second aperture 66 and preventing withdrawal of first catch 54. A loop is thereby formed by engaging element 46 such that an article to be monitored can securely be maintained therein.

It is to be understood that while a ball mechanism is illustrated herein, other attaching mechanisms known in the art may be substituted therefor without departing from the essence of the invention. In a single use theft deterrent device, the authorized user is provided with a cutting tool that is capable of cutting engaging element 46 from the article that is enclosed within the loop.

While the above description contains many specificities, these should not be construed as limitations on the scope of the invention, but rather as an exemplification of preferred embodiments thereof. Many other variations are possible without departing from the essential spirit of this invention. Accordingly, the scope of the invention should be determined not by the embodiments illustrated, but by the appended claims and their legal equivalents.

What is claimed is:

1. A security device attachable to an article to be monitored, comprising:

a tag body;

an engaging element for securing to the article having a first end, a middle region, and a second end;

an attaching member for securely receiving said first end and said second end of said engaging element, such that said first end does not travel through and out of said attaching member;

the attaching member also comprises a leading end and trailing end;

a ball received on a biasing member, wherein after insertion of the engaging element into the attaching member, the ball is forced upwards and prevents withdrawal of the engaging element; and said attaching member securely maintained within said tag body in a swiveling manner.

2. The device of claim 1, wherein a marker, selected from a group consisting of an electronic article surveillance device or an RFID device, is maintained within said tag body.

3. The device of claim 1, wherein the attaching member is maintained within a chamber defined within said tag body.

4. The device of claim 1, wherein the attaching member is substantially cylindrical and is maintained within a substantially cylindrical chamber defined within said tag body.

5. The device of claim 1, wherein an attaching mechanism located within said attaching member receives and securely maintains said engaging element therein.

6. The device of claim 1, wherein said attaching member further comprises:

a leading end and a trailing end;

a first aperture and a second aperture defined through the leading end, where the engaging element is received through the first and second apertures of the leading end;

a ball received on a biasing member, wherein after insertion of the engaging element into the second aperture the ball is forced towards and prevents withdrawal of the engaging element.

7. The device of claim 6, wherein said attaching member further comprises:

a first channel being defined within the attaching member and enclosing said ball and biasing member therein in a moveable manner;

a top portion and a bottom portion being defined on said channel, where said top portion is proximal to said second aperture and maintains said ball proximal to said second aperture;

a second channel is axially aligned with said second aperture and extends from the trailing end to said leading end and intersects said first channel at the top portion thereof;

said engaging element being inserted into said aperture and extending into said second aperture and the ball exerting a force on said engagement element to prevent the withdrawal thereof.

8. The device of claim 7, a first catch being defined at a tip of said first end;

said first catch is engaged by said ball which occludes the second aperture and prevents the withdrawal of the first catch.

9. A security device attachable to an article to be monitored, comprising:

a tag body;

an engaging element forming a loop to secure at least a portion of said article;

an attaching member for securely receiving said engaging element;

a leading end and a trailing end defined on said attaching member;

a first aperture and a second aperture defined through the leading end, where the engaging element is received through the first and second apertures of the leading end;

a ball received on a biasing member, wherein after insertion of engaging element into the second aperture the ball is forced towards and prevents withdrawal of the engaging element;

said attaching member securely maintained within said tag body in a moveable manner with the leading end exposed outside the tag body;

whereby, torque applied to the engaging element does not result in a twisting of the loop.

10. The device of claim 9, wherein torque applied to the engaging element causes the attaching member to swivel within said tag body such that twisting deformation is not caused in the engaging element.

11. The device of claim 9, wherein the attaching member has a shape selected from a group consisting of substantially cylindrical, substantially spherical, and substantially conical.

12. The device of claim 9, wherein a chamber defined by said tag body maintains said attaching member in a secure yet swiveling manner.

13. The device of claim 10, wherein a theft deterrent marker is maintained within said tag body.

14. An electronic article surveillance (EAS) tag attachable to an article to be monitored, comprising:

a tag body having an EAS marker therein;

an engaging element having a first end and a second end interconnected by a middle region, and the engaging element securing to the article by forming a loop around at least a portion of said article;

an attaching member securely receiving the first and second ends of said engaging element and securely attaching to the article, wherein the first end does not travel through and out of said attaching member;

said attaching member securely maintained within a chamber defined by said tag body in a secure manner, yet the attaching member being moveable within said chamber;

wherein said engaging element further comprises a flexible lanyard having a first catch attached to said first end, and a second catch attached to said second end, said second catch securely maintained within the attaching member yet allowing the engagement element to extend out of the tag body;

the first end passing through the portion of the article and first catch passing through a second aperture defined in the attaching member;

an attaching mechanism receiving said catch in a secure manner within the attaching member;

wherein said attaching member further comprises a first channel being defined within the attaching member and enclosing a ball and biasing member therein in a moveable manner;

a top portion and a bottom portion being defined on said channel, where said top portion is proximal to said second aperture and maintains said ball proximal to said second aperture;

a second channel is axially aligned with said second aperture and extends from the trailing end to said leading end and intersects said first channel at the top portion thereof;

said engaging element being inserted into said aperture and extending into said second aperture and the ball exerting a force on said engagement element to prevent the withdrawal thereof;

whereby, a turning force applied to the engaging element does not result in a twisting of the loop.

15. The device of claim 14, wherein said tag body is made of an inflexible material such as ABS plastic.

16. The device of claim 14, wherein torque applied to the engaging element causes the attaching member to swivel within said tag body such that twisting deformation is not caused in the engaging element.

17. The device of claim 14, wherein the attaching member has a shape selected from a group consisting of substantially cylindrical, substantially spherical, and substantially conical;

the chamber having a corresponding shape that encloses the predetermined shape of the attaching member in a moveable manner.

* * * * *